United States Patent [19]

Oren

[11] Patent Number: 4,705,177

[45] Date of Patent: Nov. 10, 1987

[54] DEVICE FOR HOLDING SKIS DURING STORAGE

[76] Inventor: Meir Oren, 149 Derech Salame, Tel Aviv, Israel

[21] Appl. No.: 746,986

[22] Filed: Jun. 19, 1985

[30] Foreign Application Priority Data

Feb. 17, 1985 [IL] Israel ..... 74363

[51] Int. Cl.[4] ..... A47F 7/00

[52] U.S. Cl. ..... 211/70.5; 248/113

[58] Field of Search ..... 211/70.5, 65, 66, 67, 211/68, 60.1; 248/113, 110; 24/488

[56] References Cited

U.S. PATENT DOCUMENTS

| | | | |
|---|---|---|---|
| 121,458 | 12/1871 | Groff | 248/113 |
| 198,714 | 12/1877 | Uibel | 248/113 |
| 353,716 | 12/1886 | Spencer | 248/113 |
| 380,320 | 4/1888 | Gash | 248/113 |
| 958,570 | 5/1910 | Watson | 211/65 X |
| 1,117,491 | 11/1914 | Hornung | 248/113 X |
| 1,435,842 | 11/1922 | Hartman, Sr. | 248/113 |
| 1,552,252 | 9/1925 | Webb | 248/113 |
| 1,798,028 | 3/1931 | Nachtigal | 248/113 |
| 1,911,781 | 5/1933 | Wolfe, Jr. | 248/113 |
| 1,925,767 | 9/1933 | Mallory | 248/113 |
| 2,807,431 | 9/1957 | McHale | 248/113 |
| 2,956,812 | 10/1960 | Lundquist | 211/70.5 |
| 3,812,976 | 5/1974 | Rempel | 211/65 X |

FOREIGN PATENT DOCUMENTS

| | | | |
|---|---|---|---|
| 64198 | 7/1975 | Australia | 248/113 |

*Primary Examiner*—Reinaldo P. Machado
*Assistant Examiner*—Sarah A. Lechok Eley
*Attorney, Agent, or Firm*—Toren, McGeady & Associates

[57] ABSTRACT

A device for holding skis and other elongated articles comprises a pair of holding members each of which includes a shaft on which there are keyed at a distance from each other two rollers of a moderately yielding material, with rollers of one holding member at a short distance from those of another holding member, each of the holding members being supported by an arm of springy material, the arms being adapted to be affixed to a stationary member.

A preferred embodiment of the device includes a C-profiled runner bar to which the springy arms are affixed.

6 Claims, 9 Drawing Figures

DEVICE FOR HOLDING SKIS DURING STORAGE

BACKGROUND AND FIELD OF INVENTION

Those who are active in winter sports, especially skiing are aware of the fact—which frequently amounts to a positive nuisance—that skiers during interruptions and rest period spent indoors, and also "after-ski" deposit the skis in lounges and ante-rooms of hotels, resorts and rest houses by standing them up against the wall of the respective room. This practice is objectionable because the skiis are likely to slide down on the wall and drop to the ground, creating an obstruction to persons who have to walk across that room. Another problem connected with this winter sport equipment is that of storing the skis during those periods of time during which they are not in use.

It is the object of this invention to provide a device which ensures the orderly and safe deposition of skiis at the wall of a room at all times when the skis are not in use, so that these have to be placed at a predetermined location and are held against dropping to the ground, safe from being damaged and safe against injuring or otherwise harming persons passing through a room at which skis have been placed without regard to order, safety and security, and also to keep the skiis in storage when not used without likelihood of damage to the expensive and easily damaged skis.

SHORT SUMMARY OF DISCLOSURE

According to the invention the new device for holding skis comprises a pair of holding members each of which includes a shaft on which are keyed at a distance from one another two rollers of moderately yielding material, with rollers of one holding member at a short distance from those of another holding member, each of the said holding members being carried on an arm of springy material, the said arms being adapted to be affixed to a static member.

In a preferred embodiment of the invention, there are provided—associated with each one of the said holding members and its springy arms a rigid member which abuts against a wall or other stationary surface to which the said static member is affixed, the said rigid member preventing the skis from tilting forwardly under their own weight when held between the pair of holding members.

In yet another embodiment of the invention the said holding members are turnable to a limited degree about a vertical axis.

In yet another practical embodiment the springy arms are in the form of sickle or crescent shaped members with a shaft on which the rolers are keyed, being passed through the two free ends of the sickle—or crescent shaped members, these latter being attached to a stationary member by a rigid connector.

In yet another embodiment the springy arms are formed by two pairs of scissor like members in each member there being two interlinked parts, connected by a pin about which both swing, springs controlling the relative movement of the two parts in each scissor like member, the scissor like members carrying the said holding members.

The new device is most advantageously employed in establishments where at the same time a number of skis have to be accommodated. In such cases a multiple number of pairs of holding members are affixed to runner bars (as will become clear from the following detailed decription), but it would be within the scope of the invention to employ one or two pairs of holders, as might be the case in domestic establishments.

In such a case the single pair or two pairs of holders may be affixed directly to the wall of a room.

SHORT DESCRIPTION OF DRAWINGS

The invention will now be described with reference to the annexed drawings wherein:

FIG. 2 is a plan view of the new device, while

Figure 1:
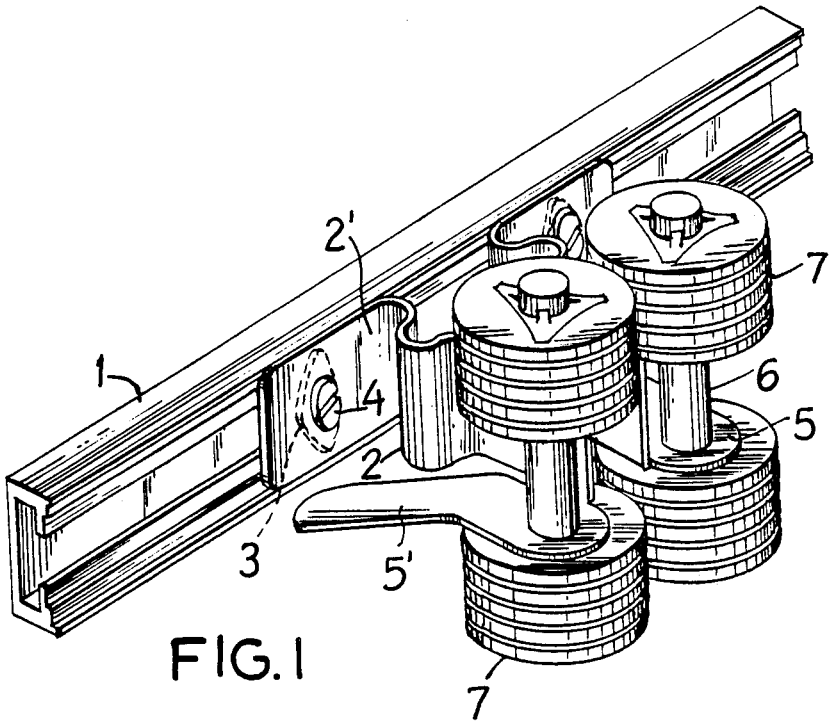
FIG. 1 shows the new device in a perspective view.
Figure 2:
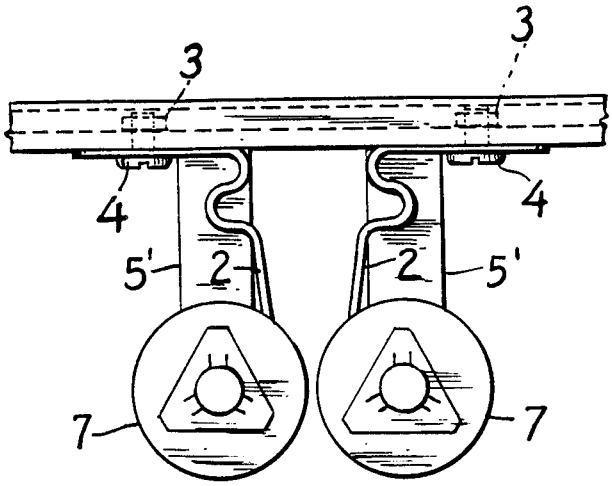

Turning first to FIG. 1, there is seen a rail of C-profile, indicated by the numeral 1. This rail is presumed to be affixed to the wall of a room by conventional means, such as screws or Rawl plugs (Trade Mark). On this rail are carried two springy arms 2 (see also FIG. 2). The free ends of arms 2 are bent off at approximately 90° forming a flat portion 2', by means of which the arms 2 are affixed to the rail 1 in the following way: The bent off portion 2' of an arm 2 is laid against the runner rail 1 with a hole in portion 2' in register with the frontal slot in the rail. Now, (or before the said step) a nut 3 is passed into the interior space of the C-rail. This nut is of a rhomboidal shape, i.e. it can enter the slot of the runner rail with its minor axis across the slot. It can then be turned through about 90°, so that its major axis extends across the slot, such that it is held in the interior of the rail. Now a screw 4 is passed through a hole in portion 2', is made to engage the nut and is screwed fast, such that the portion 2' of arm 2 is fixed to the rail. In the same way a second arm 2 is screwed to the rail. It can easily be understood that holders fixed in that way to the runner bar can be shifted nearer to or farther away from one another, as might be required or expedient in a special case.

At the opposite ends of arms 2 an upper and lower portion thereof are bent through 90° to form ears 5 (only the lower ones being seen in FIG. 1). In these ears 5 is journalled a shaft 6 which carries—keyed to it—two rollers 7 of a moderately yielding material, such as semi-hard rubber or plastics. To each shaft 6 two rollers keyed at a distance from one another.

Advantageously, but not necessarily, the lower one of ears 5 is extended by a portion 5' towards the runner bar 1—for a purpose to be described later.

Figure 3:
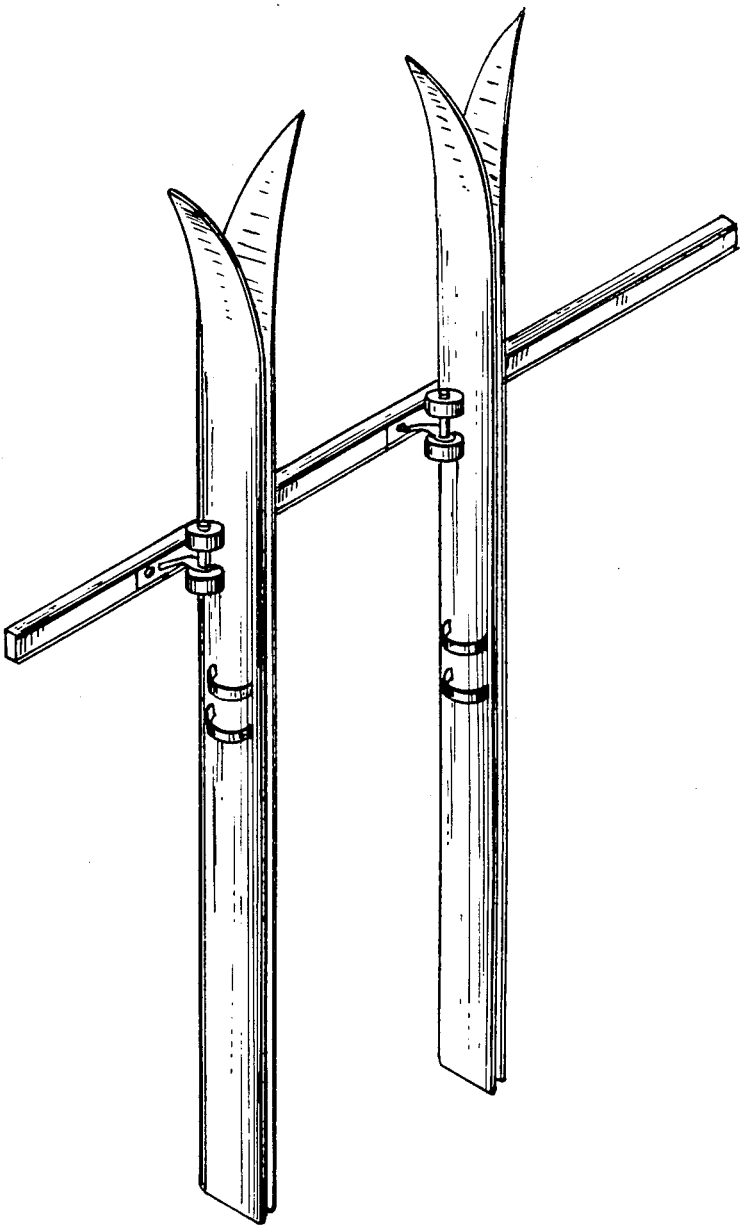
FIG. 3 illustrates the use of the device.

The new device functions as follows:

Into the narrow gap (indicated by an arrow in FIG. 1) two skis are forcibly inserted (see FIG. 3) against the bias of the springy arms 2 which tend to keep the two holders close to one another. The skis extend upwardly and downwardly relative to rail 1 and are securely held by friction between the rollers 7 and the skis. Skis have a certain weight and might exert strain on the device due to a tendency to outwardly tilting of the skis, i.e. away from the rail 1 (or the wall, as the case may be). To counteract this tendency, the extensions 5' are provided. They are supposed to contact the wall and thus support the device against the said tendency.

As has been stated, the skis are frictionally held between the rollers, which due to their resiliency, while safely holding the skis, cannot damage them, notwithstanding the pressure exerted by the springy arms 2.

Figure 4:
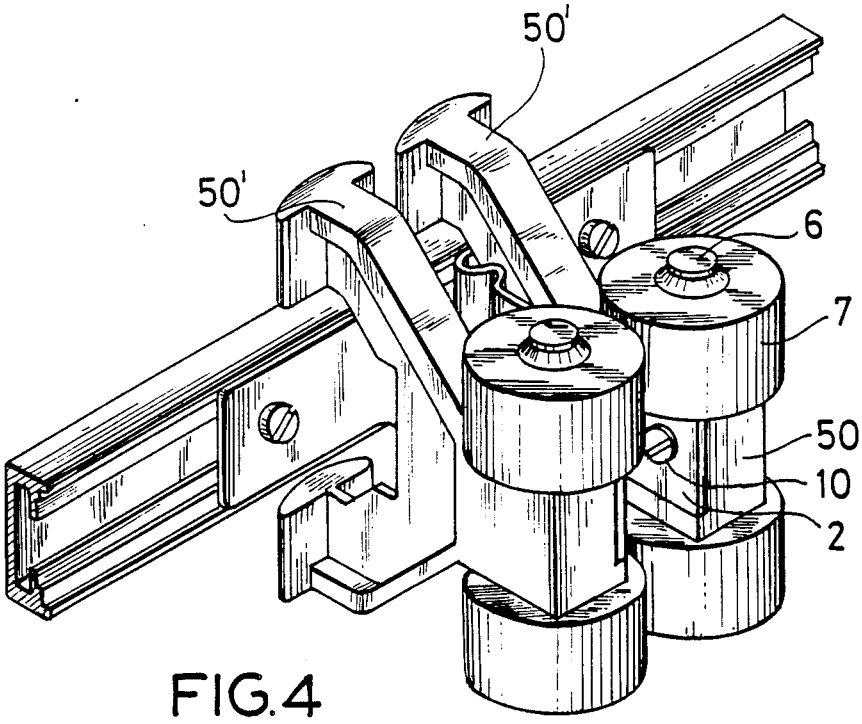
FIG. 4 is a perspective view of another embodiment of the device.
Figure 5:
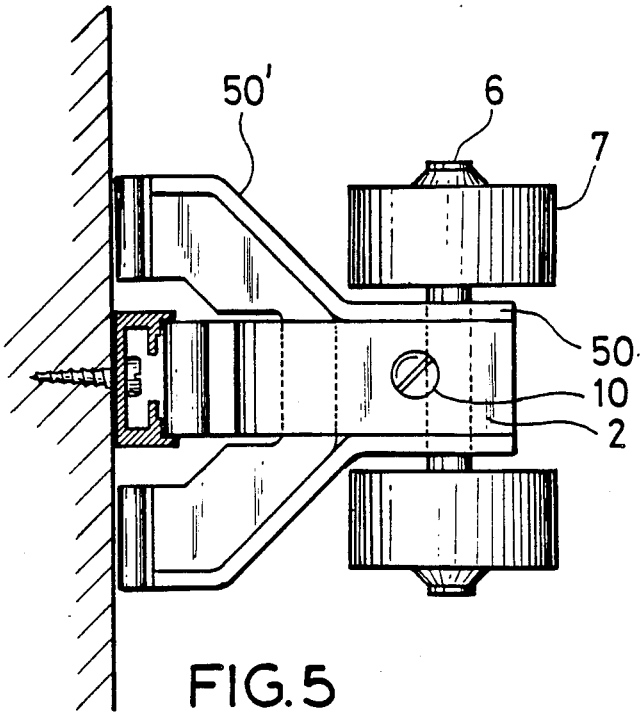
FIG. 5 is a side view of FIG. 4.
Figure 6:
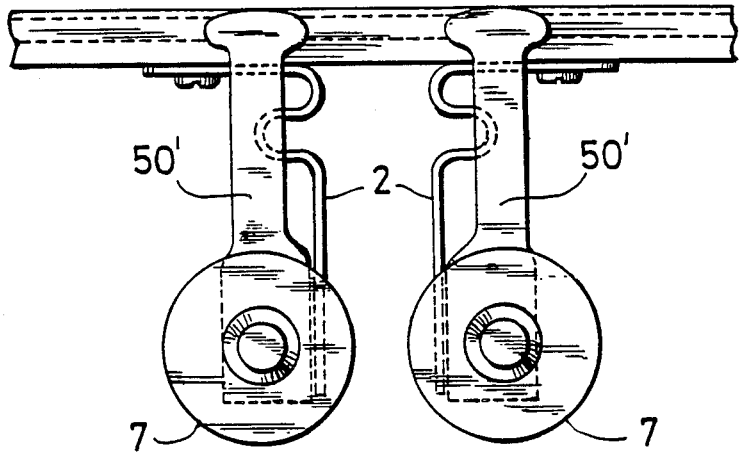
FIG. 6 is a plan view of FIG. 4.

Another embodiment of the device is shown in FIGS. 4, 5 and 6. To springy arms 2 are attached member 50, by means of screw bolt 10, member 50 is provided with extended portions 50', rollers 7 are keyed on shaft 6. This embodiment functions in the same manner as described before. Extensions 50, abut against a wall (or other surface) and counteract the forward tilt of skis held in the device.

Figure 7:
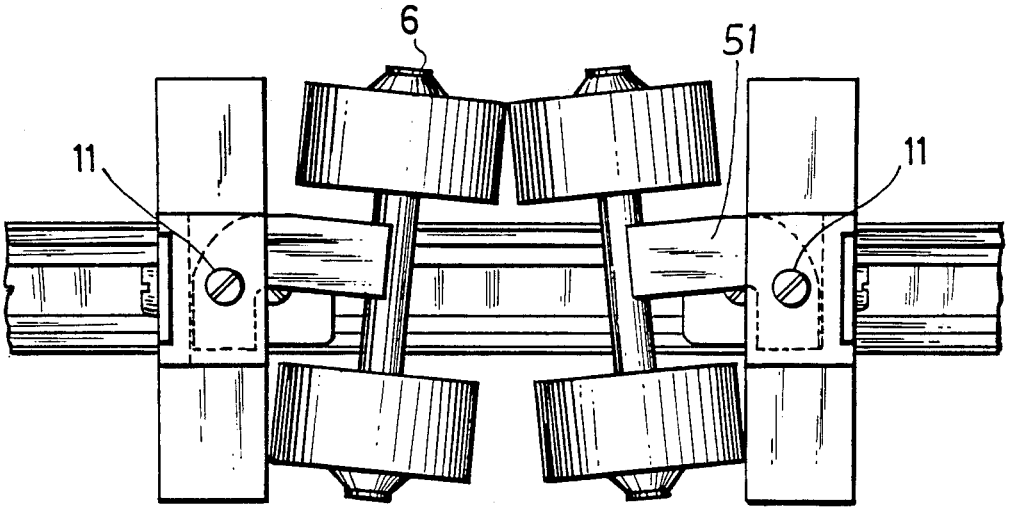
FIGS. 7, 8 and 9 are different embodiments of the device.

In the device which is shown in FIG. 7 member 50 is provided with portion 51 onto which shaft 6 is connected, e.g. by welding. Said portion 51 is pivotally connected to member 50 at 11. As stated before the skis are held by friction between the rollers 7 and the skis. In this arrangement self locking is achieved due to gravity acting on the skis.

Figure 8:
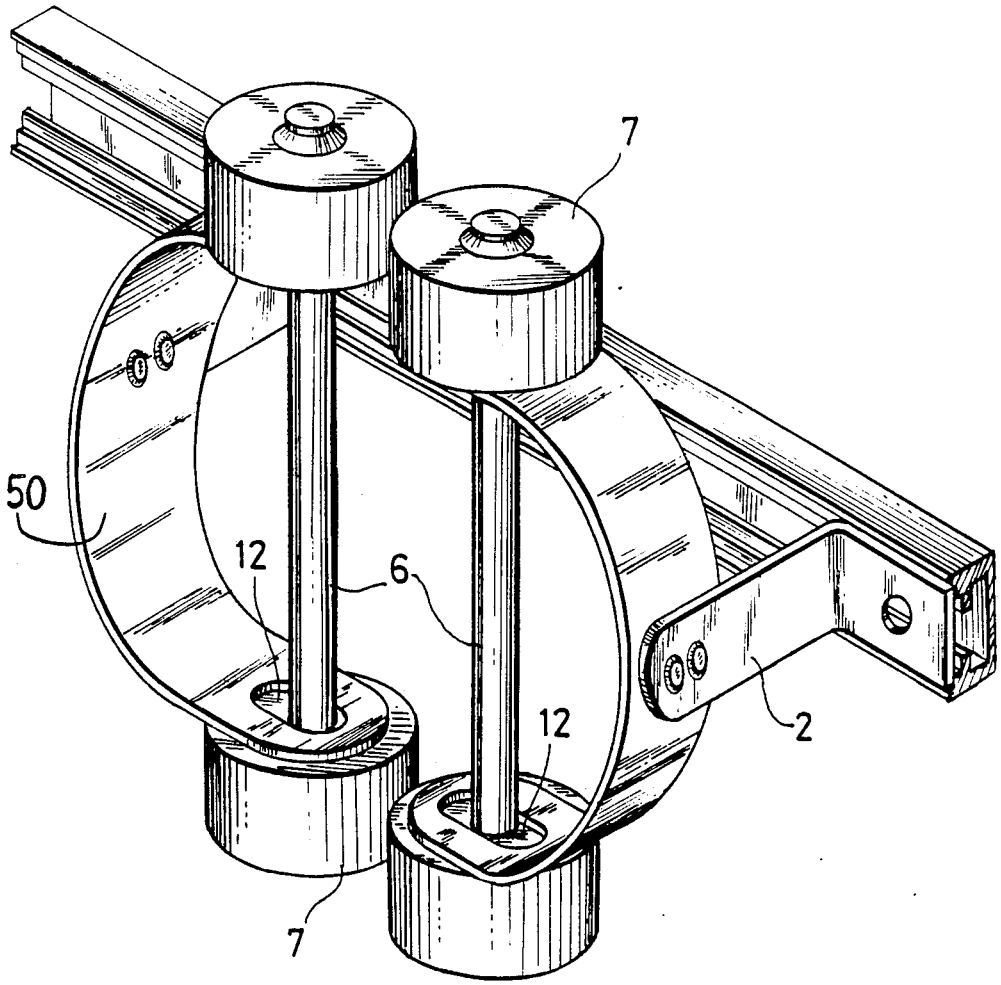

Turning now to FIG. 8, here to each rigid arm 2 is attached a sickle or crescent shaped member 50 being a springy leaf. To allow the proper function of the device, shaft 6 passes through oval holes 12, at both free ends of the member 50.

Figure 9:
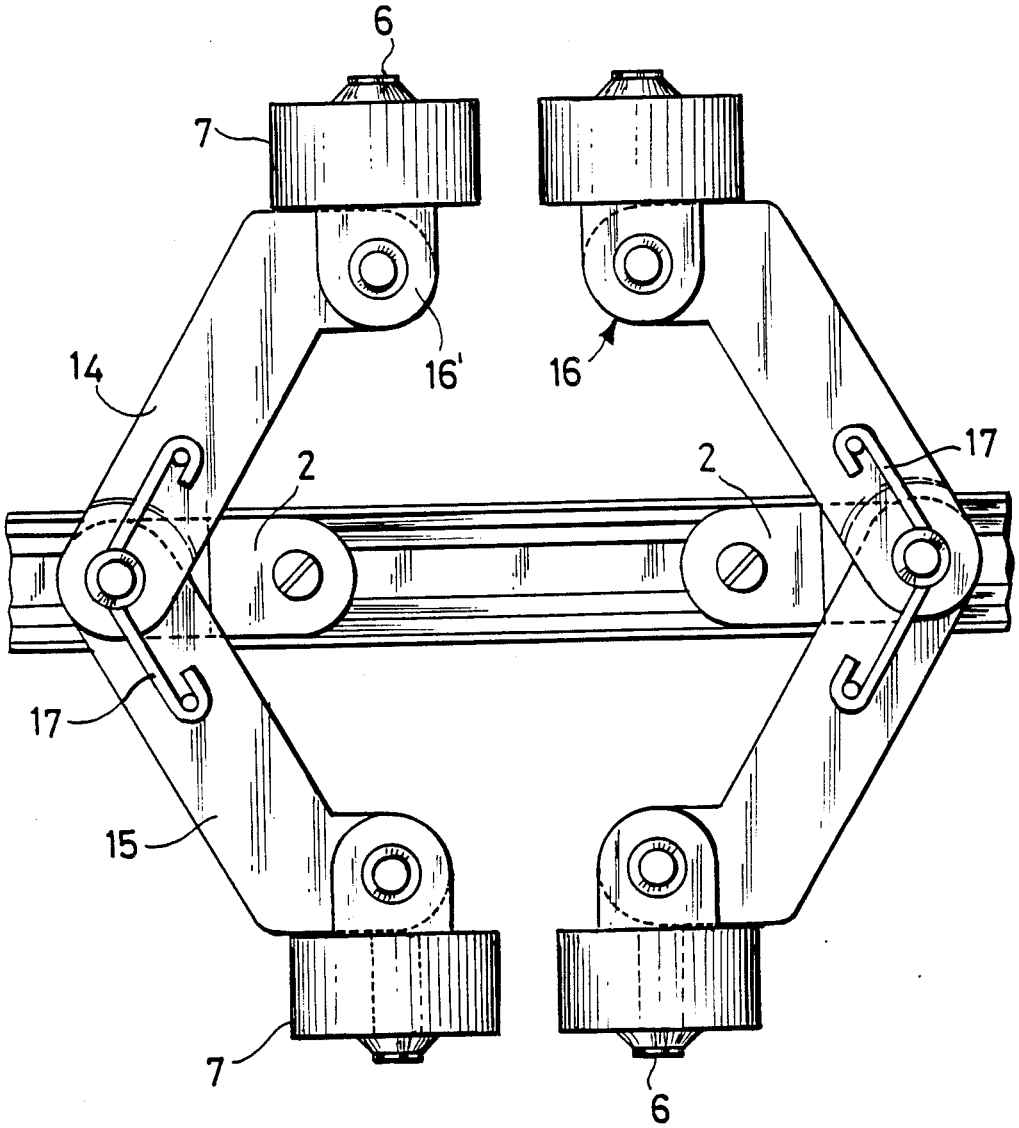

Finally the embodiment which is shown in FIG. 9 consists of arms 2 to which are pivotally connected two straight bars forming a scissor like member 14, 15. To the free ends of said bars 14 and 15 rollers 7 are connected by means of member 16 which has a flat portion 16' from which extends a short shaft 6. The springy effect of the scissor like member is achieved by means of springs 17 each with hooked ends are attached to each bar 14, 15.

While the new device has been designed for use with skis, it can be used advantageously also for holding other articles.

I claim:

1. A device for holding skis and other articles in a vertical position on a stationary support surface such as a wall, comprising a pair of separate holding members, each said holding member includes an upwardly arranged axially extending shaft, a pair of rollers mounted on said shaft and spaced apart therein in the axial direction of said shaft, said rollers being formed of a moderately yielding material, said rollers on one of said pair of holding members being in closely spaced relation with said rollers on the other one of said pair of holding members for holding skis therebetween, a separate spring arm for supporting each said holding member, a static member spaced from said rollers in the direction transversely of the axial direction of said shaft and shaped as a C-profiled runner bar arranged to be secured to a stationary support surface, each of said arms being adjustable secured to said static member for varying the spacing between said rollers on the different ones of said holding members and at least certain of said arms including a member in engagement with and extending from and transversely of said shaft to adjacent said static member for preventing said rollers and said shafts from tilting downwardly due to the weight of the skis or other articles held between the rollers by contacting the stationary support surface to which the static member is to be secured.

2. The device claimed in claim 1, characterized thereby that the said springy arms have a first portion supporting said holding members and a second portion bent off at right angles to said first portion with said second portion secured to the runner bar by means of a screw bolt passing through a hole in said second portion, entering a slot in the C-profiled runner bar and entering a tapped hole in a nut located on the opposite side of the C-profiled runner bar from said holding members, and said nut has a rhomboidal shape.

3. The device claimed in claim 1, characterised thereby that at the ends of the first portions of said springy arms which are delete from the end of the second portion affixed to the runner bar, are formed ears in which the said shafts are journalled.

4. The device as claimed in claim 3, characterised thereby that the lower one of the said ears is extended towards the said static member and forms said member for preventing tilting.

5. The device claimed in claim 1, characterised by the springy arms being a sickle or crescent shaped member.

6. The device claimed in claim 1, characterised thereby that the holding members are attached to the arms in a manner permitting limited movement about a vertical axis.

* * * * *